US011542083B2

(12) United States Patent
Donschietz

(10) Patent No.: US 11,542,083 B2
(45) Date of Patent: Jan. 3, 2023

(54) VIAL BLINDING ASSEMBLIES AND METHODS OF ASSEMBLY

(71) Applicant: FISHER CLINICAL SERVICES, INC., Allentown, PA (US)

(72) Inventor: Michael Donschietz, Macungie, PA (US)

(73) Assignee: FISHER CLINICAL SERVICES, INC., Allentown, PA (US)

( * ) Notice: Subject to any disclaimer, the term of this patent is extended or adjusted under 35 U.S.C. 154(b) by 77 days.

(21) Appl. No.: 17/002,481

(22) Filed: Aug. 25, 2020

(65) Prior Publication Data

US 2021/0094743 A1 Apr. 1, 2021

Related U.S. Application Data

(60) Provisional application No. 62/908,113, filed on Sep. 30, 2019.

(51) Int. Cl.

| | |
|---|---|
| ***B65D 77/04*** | (2006.01) |
| ***B65D 51/00*** | (2006.01) |
| ***B65D 23/08*** | (2006.01) |
| ***B65D 51/18*** | (2006.01) |
| ***A61J 1/14*** | (2006.01) |
| ***A61J 1/16*** | (2006.01) |
| ***A61J 1/06*** | (2006.01) |

(52) U.S. Cl.

CPC ..... *B65D 77/0486* (2013.01); *A61J 1/065* (2013.01); *A61J 1/1406* (2013.01); *A61J 1/16* (2013.01); *B65D 23/0842* (2013.01); *B65D 23/0885* (2013.01); *B65D 51/002* (2013.01); *B65D 51/18* (2013.01); *B65D 77/0493* (2013.01)

(58) Field of Classification Search

CPC ..... B65D 77/0489; B65D 77/0493; B65D 23/0885; B65D 23/0842; B65D 51/002; B65D 51/18; A61J 1/1406; A61J 1/16; A61J 1/065

USPC ..... 206/528, 535; 220/23.91; 215/249

See application file for complete search history.

(56) References Cited

U.S. PATENT DOCUMENTS 2,438,906 A 4/1948 Elasa et al.
2,750,066 A 6/1956 Shekter
(Continued)

FOREIGN PATENT DOCUMENTS

AU 441022 9/1973

*Primary Examiner* — Don M Anderson
*Assistant Examiner* — Jennifer Castriotta
(74) *Attorney, Agent, or Firm* — Michael Best & Friedrich LLP

(57) ABSTRACT

A vial blinding assembly includes a vial having a bottle with a constricted neck and an annular shoulder that inwardly extends; a stopper disposed on an opening of the bottle and having a septum with a top surface; and a retainer securing the stopper to the bottle. A tubular blinding shell encircles a compartment that extends between a first end with an inlet opening and an opposing second end with an access opening. A floor plug is secured to the first end of the blinding shell. The vial is disposed within compartment of the blinding shell with the vial being supported by the floor plug and the neck passing through the access opening so that the top surface of the septum is disposed outside of the compartment of the blinding shell, the shoulder of the vial having an outside diameter larger than a diameter of the access opening.

20 Claims, 9 Drawing Sheets

(56) References Cited

U.S. PATENT DOCUMENTS

| | | | | | |
|---|---|---|---|---|---|
| 2,889,065 | A | * | 6/1959 | Lawlor | A45D 34/02 215/12.1 |
| 4,159,764 | A | | 7/1979 | Schinke | |
| 4,366,912 | A | | 1/1983 | Matukura | |
| 4,441,621 | A | | 4/1984 | Matukura | |
| 4,510,769 | A | * | 4/1985 | McClellan, Jr. | B65D 81/3879 215/12.1 |
| 4,545,479 | A | | 10/1985 | Figari | |
| 4,664,277 | A | | 5/1987 | Connor | |
| 4,949,858 | A | | 8/1990 | Sheridan | |
| 5,143,261 | A | | 9/1992 | Drobish | |
| 5,316,146 | A | | 5/1994 | Graff | |
| 5,590,782 | A | | 1/1997 | Haber et al. | |
| 5,673,822 | A | * | 10/1997 | Chalmin | A61F 9/0008 222/183 |
| 8,007,883 | B2 | | 8/2011 | Durr | |
| 9,192,543 | B2 | | 11/2015 | Hunkeler et al. | |
| 2004/0129596 | A1 | | 7/2004 | Geert et al. | |
| 2007/0163914 | A1 | | 7/2007 | Gehring et al. | |
| 2012/0006712 | A1 | * | 1/2012 | Kaplan | G09F 3/10 206/459.5 |
| 2012/0292219 | A1 | * | 11/2012 | Terwilliger | G09F 3/10 206/459.5 |
| 2013/0240535 | A1 | | 9/2013 | Grajqevci | |
| 2019/0358125 | A1 | * | 11/2019 | Chhikara | A61J 1/2089 |

* cited by examiner

VIAL BLINDING ASSEMBLIES AND METHODS OF ASSEMBLY

CROSS-REFERENCE TO RELATED APPLICATIONS

This application claims the benefit to U.S. Provisional Application No. 62/908,113, filed Sep. 30, 2019, which is incorporated herein by specific reference.

BACKGROUND OF THE DISCLOSURE

1. The Field of the Disclosure

The present disclosure relates to blinding shells that can be used to cover vials during blinded studies of therapeutic drugs and to related methods.

2. The Relevant Technology

A large number of therapeutic drugs are provided in liquid form and are administered using a syringe. Such drugs are commonly housed within a vial. Dispensing of the drug typically requires passing a needle through a stopper of the vial and withdrawing a dosage of the drug into the syringe. The needle is then retracted from the vial and subsequent inserted into a patient for dispensing of the drug. Blinded testing of such drugs during clinical trials requires that the vials be shielded so that the drug cannot be analyzed by the patient or the person administering the drug.

In one approach to shielding the vial, the vial is enclosed within an opaque blinding shield having a small opening that is aligned with the stopper of the vial. During use, a needle of a syringe is simply passed through the opening of the blinding shield and through the stopper so that the drug, comparator or placebo being used in the blinded study can be withdrawn into the syringe and subsequently dispensed.

Although such blinding shields are effective at shielding a vial, they have a number of shortcomings. For example, because the stopper of the vial is disposed within the blinding shield and cannot be accessed, it is not possible (or at least not practical) to clean the stopper where the needle passes, either prior to initial use or between subsequent uses. As such, there is an increased risk of contamination of the dosage being tested.

Furthermore, vials commonly come in different heights. However, using blinding shields of different heights to properly fit the vials of different heights complicates production of the blinding shields and can complicates the packaging and storage of such blinding shields. In addition, using blinding shields of different sizes can defeat the blinded study by suggesting or implying differences in what is being housed in different vials of different sized blinding shields.

Accordingly, what is needed are blinding shields and assemblies that overcome all or some of the above shortcomings and other problems known in the art.

SUMMARY OF THE DISCLOSURE

In one embodiment of the present disclosure, a vial blinding assembly includes:

a vial comprising:

a bottle comprising a body, a constricted annular neck, and an annular shoulder that inwardly extends from the body to the neck, the neck bounding an opening to a chamber of the bottle;

a stopper disposed on the bottle so as to cover the opening, the stopper comprising a needle penetrable septum aligned within the opening, the septum having an top surface disposed outside of the chamber of the bottle; and a retainer securing the stopper to the bottle;

a tubular blinding shell having a sidewall that encircles a compartment and that extends between a first end and an opposing second end, the sidewall encircling an inlet opening at the first end and an access opening at the second end; and a floor plug secured to the first end of the blinding shell;

wherein the vial is disposed within compartment of the blinding shell with the vial being supported by the floor plug and the neck passing through the access opening so that the top surface of the septum is disposed outside of the compartment of the blinding shell, the shoulder of the vial having an outside diameter larger than a diameter of the access opening of the blinding shell so that the vial is precluded from passing out of the compartment of the blinding shell through the access opening.

In another embodiment, the sidewall of the tubular blinding shell comprises an annular shoulder that inwardly extends.

In another embodiment, the sidewall of the tubular blinding shell comprises:

a tubular lower portion that includes the first end and that has a maximum outer diameter;

a tubular upper portion that includes the second end and that has a maximum outer diameter, the maximum outer diameter of the lower portion being larger than the maximum outer diameter of the upper portion; and the annular shoulder extending between the upper portion and the lower portion.

In another embodiment, the annular shoulder of the sidewall blocks the annular shoulder of the bottle from passing out through the access opening.

In another embodiment, the lower portion, the upper portion and the annular shoulder of the blinding shell comprise a single, integral, unitary member as opposed to two or more members that are connected together.

In another embodiment, at least a portion of the lower portion is cylindrical and at least a portion of the upper portion is cylindrical.

In another embodiment, the tubular blinding shell is opaque.

In another embodiment, the floor plug couples with the blinding shell by a snap fit connection so that the floor plug cannot be manually separated blinding shell.

In another embodiment, the floor plug is fully or at least partially disposed within the compartment of the blinding shell.

In another embodiment, the vial blinding assembly further includes:

the blinding shell having an interior surface with an annular recess being formed into the interior surface at the first end so that the annular recess encircles the compartment; and the floor plug having an annular ridge received within the recess.

In another embodiment, the floor plug has a top surface disposed within the compartment of the blinding shell and an opposing bottom surface, the floor plug having a maximum thickness extending between the top surface and the bottom surface that is greater than 0.5 cm, 1 cm, 1.5 cm or 2 cm.

In another embodiment, the floor plug has a top surface disposed within the compartment of the blinding shell and an opposing bottom surface, the floor plug having a maximum thickness extending between the top surface and the bottom surface that is less than 0.5 cm, 0.3 cm, or 0.2 cm.

In another embodiment, the floor plug has a planar top surface disposed within the compartment of the blinding shell, the vial resting directly on the planar top surface of the floor plug.

In another embodiment, the second end of the blinding shell terminates at an annular lip that radially encircles the retainer.

In another embodiment, the annular lip of the blinding shell has an inside diameter and the retainer has a maximum outside diameter, the difference between the inside diameter of the annular lip and the maximum outside diameter of the retainer being less than 1 cm or 0.5 cm.

In another embodiment, the floor plug is opaque.

In another embodiment, the retainer comprises:

an annular collar encircling a portion of the bottle and encircling a portion of the stopper; and a flange radially inwardly projecting from an upper end of the collar so as to extend over a portion stopper, the flange terminating at an inner face that encircles an aperture, the aperture being aligned with the top surface of the septum.

In another embodiment, the vial blinding assembly further includes a cap removably coupled to the retainer so as to cover the aperture of the retainer and the top surface of the septum.

In another embodiment, a liquid trial product is disposed within the chamber of the bottle.

In another embodiment, the liquid trial product comprises an active drug product that is under investigation, a related placebo product, a control product, or a comparator product.

In another embodiment, the vial is seated directly on the floor plug.

In another embodiment, one or more inserts is disposed between the floor plug and the vial.

In another independent aspect of the present disclosure, a method for assembling a vial blinding assembly includes:

passing a vial through an inlet opening at a first end of a tubular blinding shell and into a compartment of the blinding shell, the vial comprising:

a bottle comprising a body, a constricted annular neck, and an annular shoulder that inwardly extends from the body to the neck, the neck bounding an opening to a chamber of the body;

a stopper disposed on the bottle so as to cover the opening, the stopper comprising a needle penetrable septum aligned within the opening, the septum having an top surface disposed outside of the chamber of the bottle; and a retainer securing the stopper to the bottle; and securing a floor plug to the first end of the blinding shell so that the vial is supported by the floor plug, the neck of the bottle passing through an access opening at an opposing second end of the blinding shell so that the top surface of the septum is disposed outside of the chamber of the blinding shell, the shoulder of the vial having an outside diameter larger than a diameter of the access opening of the blinding shell so that the vial is precluded from passing out of the compartment of the blinding shell through the access opening.

In another embodiment, the step of securing the floor plug comprises selecting the floor plug from a plurality of floor plugs, each of the plurality of floor plugs having a top surface and an opposing bottom surface with a maximum thickness extending therebetween, each of the plurality of floor plugs having a different maximum thickness.

In another embodiment, the vial rests directly on the top surface of the floor plug when the floor plug is secured to the blinding shell.

In another embodiment, the step of securing the floor plug comprises coupling the floor plug to the blinding shell by a snap fit connection so that the floor plug cannot be manually separated from the blinding shell.

In another embodiment, the step of securing the floor plug comprises inserting the floor plug into the compartment of the blinding shell through the inlet opening.

Another embodiment includes removing a cap secured to the retainer so as to openly expose the septum of the stopper.

In another embodiment, the method further includes:

cleaning a top surface of the septum; and passing a needle of a syringe through the septum.

In another embodiment, the step of cleaning the top surface of the septum comprises applying a sterilizing agent to the top surface of the septum.

In another embodiment, the step of cleaning the top surface of the septum comprises using a pad to manually apply a sterilizing agent to the top surface of the septum.

Another embodiment further includes:

using the syringe to withdraw a portion of a liquid trial product disposed within the chamber of the vial; and dispensing a dosage of the liquid trial product to a patient as part of a blinded study.

In another embodiment, the liquid trial product comprises an active drug product that is under investigation, a related placebo product, a control product, or a comparator product.

Another embodiment further includes positioning an insert into the compartment of the blinding shell so that the insert is disposed between the vial and the floor plug when the floor plug is secured to the blinding shell.

In another embodiment, the insert is selected from a plurality of inserts each having a different thickness.

It is appreciated that each of the features recited above and otherwise disclosed herein can be mixed and matched to produce a variety of other embodiment contemplated within the present disclosure.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
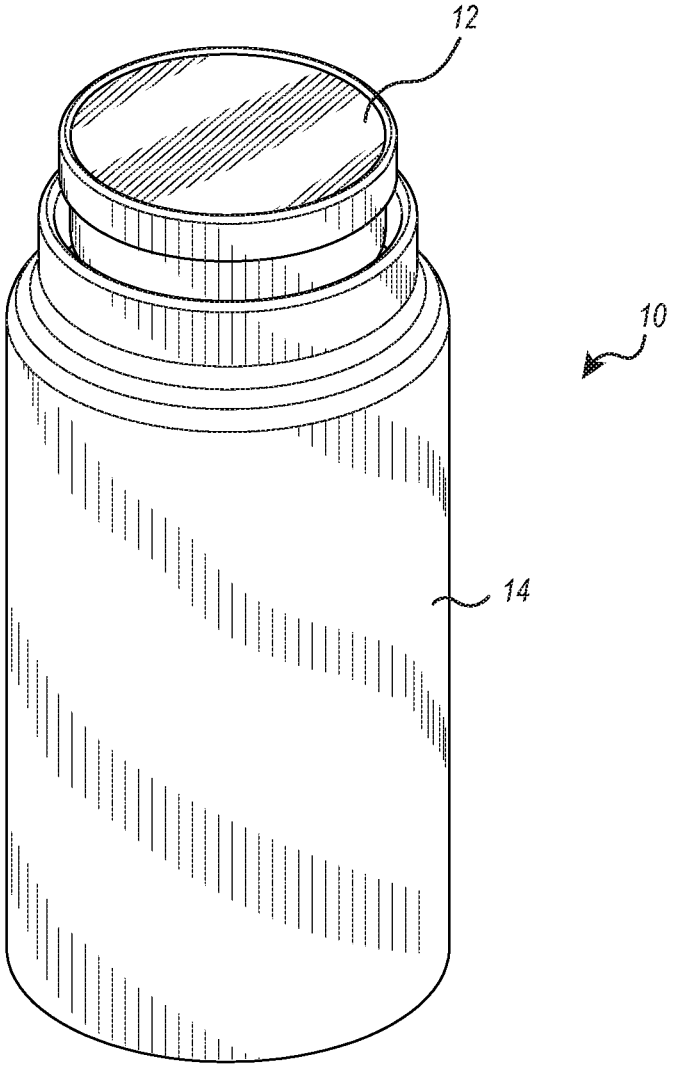
FIG. 1 is a perspective view of a vial blinding assembly.

Before describing the present disclosure in detail, it is to be understood that this disclosure is not limited to parameters of the particularly exemplified systems, methods, apparatus, products, processes, compositions, and/or kits, which may, of course, vary. It is also to be understood that the terminology used herein is only for the purpose of describing particular embodiments of the present disclosure, and is not necessarily intended to limit the scope of the disclosure in any particular manner. Thus, while the present disclosure will be described in detail with reference to specific embodiments, features, aspects, configurations, etc., the descriptions are illustrative and are not to be construed as limiting the scope of the claimed invention. Various modifications can be made to the illustrated embodiments, features, aspects, configurations, etc. without departing from the spirit and scope of the invention as defined by the claims. Thus, while various aspects and embodiments have been disclosed herein, other aspects and embodiments are contemplated.

Unless defined otherwise, all technical and scientific terms used herein have the same meaning as commonly understood by one of ordinary skill in the art to which the present disclosure pertains. While a number of methods and materials similar or equivalent to those described herein can be used in the practice of the present disclosure, only certain exemplary materials and methods are described herein.

Various aspects of the present disclosure, including devices, systems, methods, etc., may be illustrated with reference to one or more exemplary embodiments or implementations. As used herein, the terms "alternative embodiment" and/or "exemplary implementation" means "serving as an example, instance, or illustration," and should not necessarily be construed as preferred or advantageous over other embodiments or implementations disclosed herein. In addition, reference to one or more embodiments is intended to provide illustrative examples without limiting the scope of the invention, which is indicated by the appended claims rather than by the following description.

It will be noted that, as used in this specification and the appended claims, the singular forms "a," "an" and "the" include plural referents unless the content clearly dictates otherwise. Thus, for example, reference to an "insert" includes one, two, or more inserts. As used throughout this application the words "can" and "may" are used in a permissive sense (i.e., meaning having the potential to), rather than the mandatory sense (i.e., meaning must). Additionally, the terms "including," "having," "involving," "containing," "characterized by," variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

Various aspects of the present disclosure can be illustrated by describing components that are coupled, attached, connected, and/or joined together. As used herein, the terms "coupled", "attached", "connected," and/or "joined" are used to indicate either a direct connection between two components or, where appropriate, an indirect connection to one another through intervening or intermediate components. In contrast, when a component is referred to as being "directly coupled", "directly attached", "directly connected," and/or "directly joined" to another component, no intervening elements are present or contemplated. Thus, as used herein, the terms "connection," "connected," and the like do not necessarily imply direct contact between the two or more elements. In addition, components that are coupled, attached, connected, and/or joined together are not necessarily (reversibly or permanently) secured to one another.

As used herein, directional and/or arbitrary terms, such as "top," "bottom," "front," "back," "left," "right," "up," "down," "upper," "lower," "inner," "outer," "internal," "external," "interior," "exterior," "proximal," "distal" and the like can be used solely to indicate relative directions and/or orientations and may not otherwise be intended to limit the scope of the disclosure, including the specification, invention, and/or claims.

Where possible, like numbering of elements have been used in various figures. In addition, similar elements and/or elements having similar functions may be designated by similar numbering (e.g., element "10" and element "210.") Furthermore, alternative configurations of a particular element may each include separate letters appended to the element number. Accordingly, an appended letter can be used to designate an alternative design, structure, function, implementation, and/or embodiment of an element or feature without an appended letter. Similarly, multiple instances of an element and or sub-elements of a parent element may each include separate letters appended to the element number. In each case, the element label may be used without an appended letter to generally refer to instances of the element or any one of the alternative elements. Element labels including an appended letter can be used to refer to a specific instance of the element or to distinguish or draw attention to multiple uses of the element. However, element labels including an appended letter are not meant to be limited to the specific and/or particular embodiment(s) in which they are illustrated. In other words, reference to a specific feature in relation to one embodiment should not be construed as being limited to applications only within said embodiment.

It will also be appreciated that where a range of values (e.g., less than, greater than, at least, and/or up to a certain value, and/or between two recited values) is disclosed or recited, any specific value or range of values falling within the disclosed range of values is likewise disclosed and contemplated herein. Thus, disclosure of an illustrative measurement or distance less than or equal to about 10 units or between 0 and 10 units includes, illustratively, a specific disclosure of: (i) a measurement of 9 units, 5 units, 1 units, or any other value between 0 and 10 units, including 0 units and/or 10 units; and/or (ii) a measurement between 9 units and 1 units, between 8 units and 2 units, between 6 units and 4 units, and/or any other range of values between 0 and 10 units.

It is also noted that systems, methods, apparatus, devices, products, processes, compositions, and/or kits, etc., according to certain embodiments of the present disclosure may include, incorporate, or otherwise comprise properties, features, aspects, steps, components, members, and/or elements described in other embodiments disclosed and/or described herein. Thus, reference to a specific feature, aspect, steps, component, member, element, etc. in relation to one embodiment should not be construed as being limited to applications only within said embodiment. In addition, reference to a specific benefit, advantage, problem, solution, method of use, etc. in relation to one embodiment should not be construed as being limited to applications only within said embodiment.

The headings used herein are for organizational purposes only and are not meant to be used to limit the scope of the description or the claims. To facilitate understanding, like reference numerals have been used, where possible, to designate like elements common to the figures.

The present disclosure is directed to vial blinding assemblies used in blinded studies of therapeutic drugs and related methods. In general, the vial blinding assemblies include a vial holding a liquid trial product and a tubular blinding shell with floor plug that cover the vial. The tubular blinding shell with floor plug function to help preclude those receiving or administering the liquid trial product from the vial from detecting any properties of the liquid trial product within the vial so that the fidelity and efficacy of the blinded study is maintained.

Figure 2:
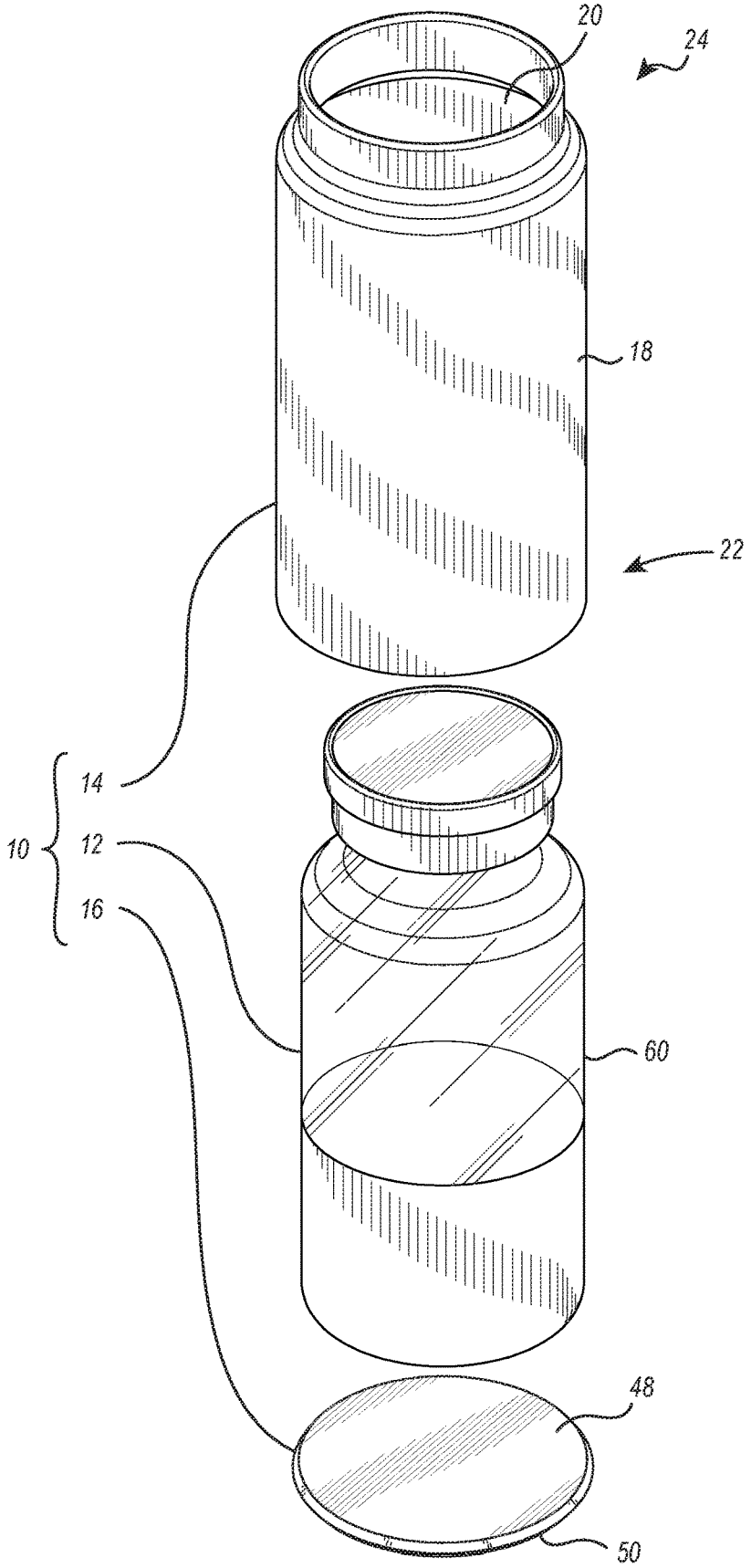
FIG. 2 is partially exploded perspective view of the vial blinding assembly shown in FIG. 1.
Figure 6:
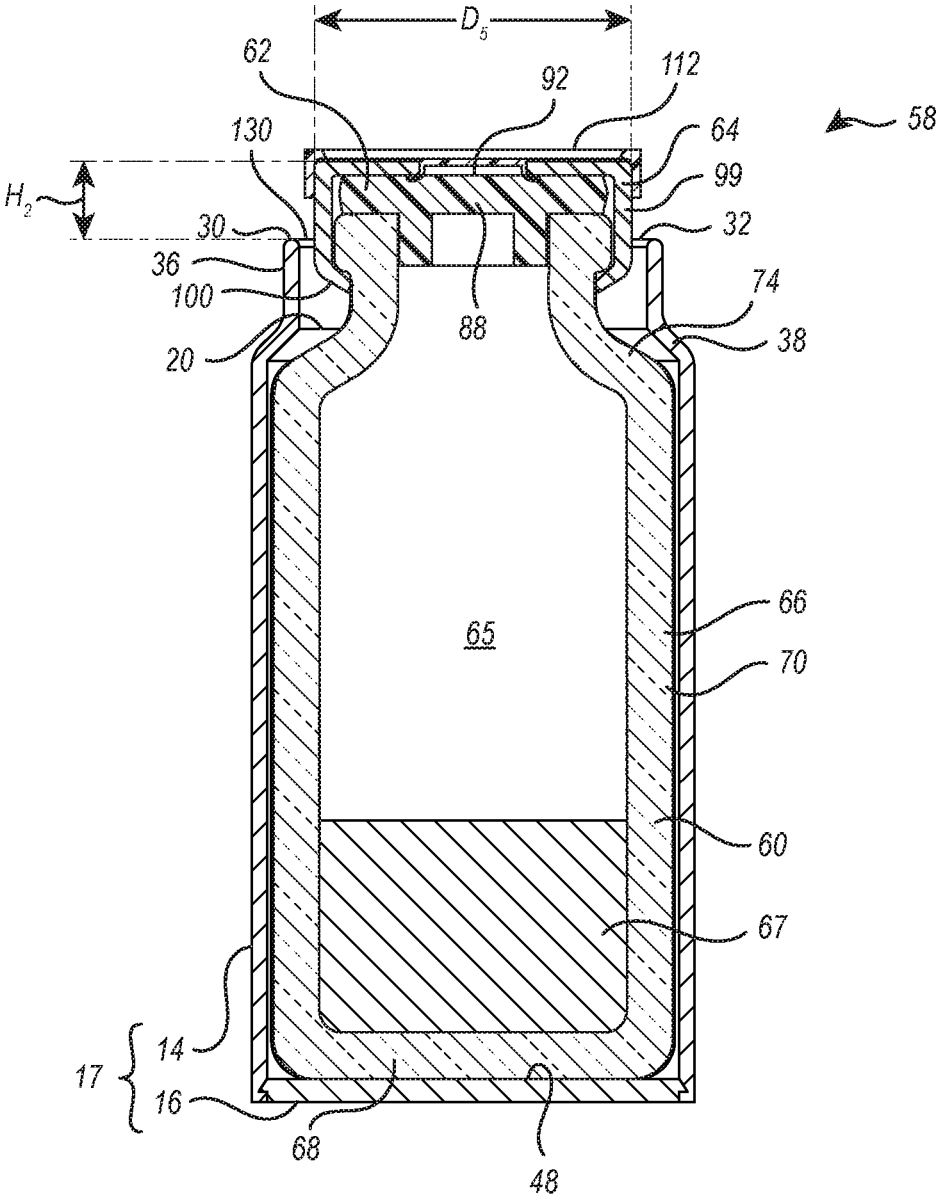
FIG. 6 is a cross sectional view of the vial blinding assembly shown in FIG. 1.

Depicted in FIG. 1 is a perspective view of one embodiment of a vial blinding assembly 10 incorporating features of the present disclosure. As depicted in FIG. 2, vial blinding assembly 10 comprises a vial 12 that is selectively housed within a tubular blinding shell 14. A floor plug 16 is secured to blinding shell 14 to secure and help cover vial 12 within blinding shell 14. Blinding shell 14 and floor plug 16 combine to form a blinding shield 17 (FIG. 6). Blinding shell 14 is tubular having a sidewall 18 that encircles a compartment 20 and that extends between a first end 22 and an opposing second end 24. As better seen in FIG. 3, sidewall 18 includes an interior surface 27 and an opposing exterior surface 29 that both extend between opposing ends 22 and 24. Interior surface 27 encircles and partially bounds compartment 20. First end 22 terminates at an annular lip 26. Annular lip 26 encircles an inlet opening 28 that communicates with compartment 20. Similarly, second end 24 terminates at an annular lip 30. Annular lip 30 encircles an access opening 32 that communicates with compartment 20. In one embodiment, inlet opening 28 and access opening 32 are the only openings that communicate with compartment 20.

Figure 3:
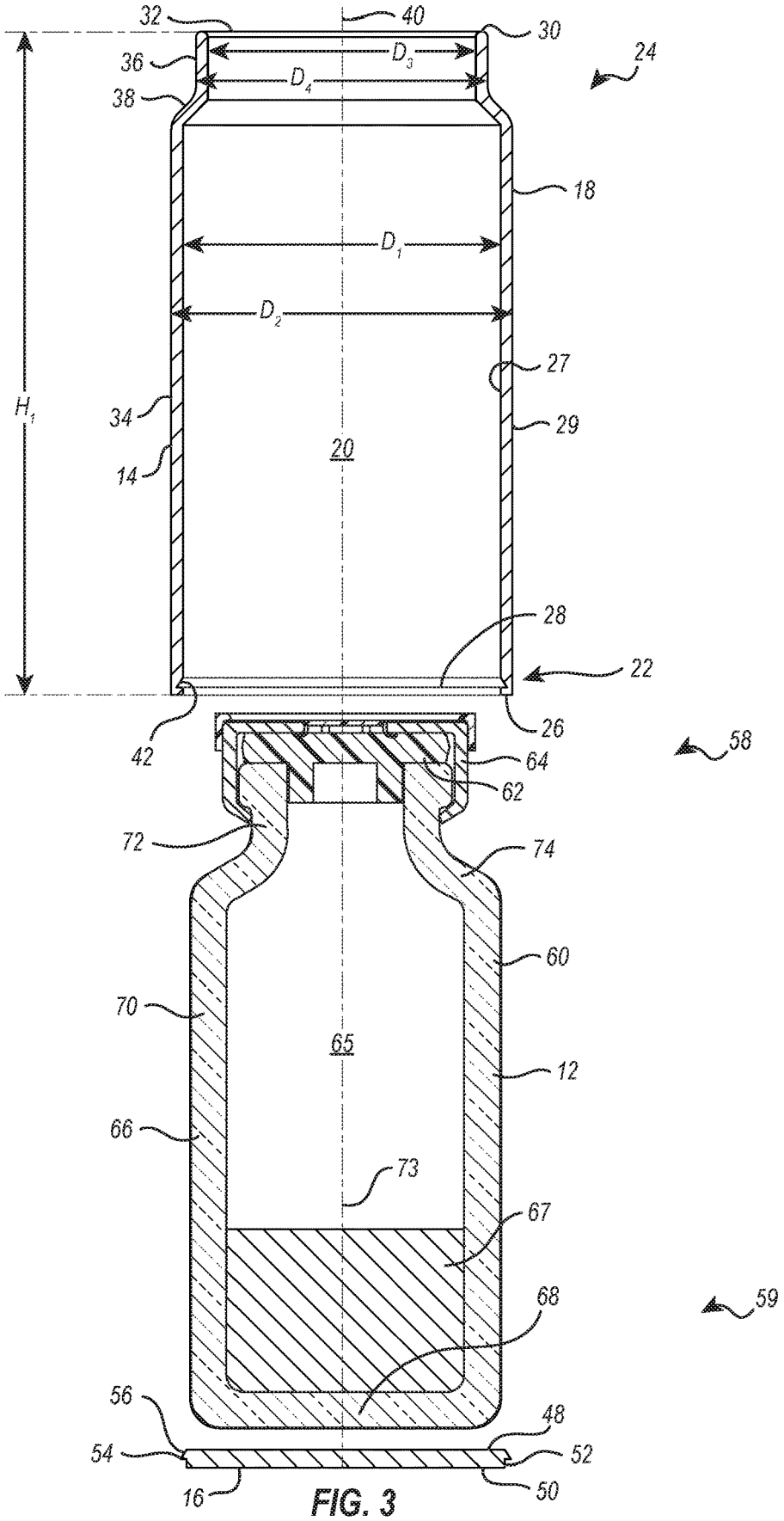
FIG. 3 is a cross sectional view of the exploded vial blinding assembly shown in FIG. 2.

With continued reference to FIG. 3, sidewall 18 is further defined as comprising a tubular lower portion 34 that includes first end 22 and a tubular upper portion 36 that includes second end 24. An annular shoulder 38 inwardly tapers from lower portion 34 to upper portion 36. Lower portion 34, upper portion 36 and annular shoulder 38 of blinding shell 14 can comprise a single, integral, unitary member as opposed to two or more members that are connected together. In the depicted embodiment lower portion 34 has a maximum inner diameter $D_1$ and a maximum outer diameter $D_2$. Likewise, upper portion 36 has a maximum inner diameter $D_3$ and a maximum outer diameter $D_4$. In this embodiment, diameter $D_1$ is greater than diameter $D_3$ while diameter $D_2$ is greater than diameter $D_4$. As a result, annular shoulder 38 inwardly slops as it extends between lower portion 34 and upper portion 36. Annular shoulder 38 is shown sloping at an inside angle relative to a central longitudinal axis 40 of blinding shell 14 that is less than 90° and is more commonly between 30° and 60°. Other angles can also be used. In other embodiments, shoulder 38 could radially inwardly project so as to extend orthogonal to central longitudinal axis 40. However, as discussed below in more detail, having shoulder 38 slope at an acute angle will typically achieve a more complementary engagement or alignment with vial 12.

Interior surface 27 and exterior surface 29 of blinding shell 14 are shown as having substantially complimentary configurations. As such, the thickness of sidewall 18 is substantially constant as it extends from first end 22 to second end 24. As depicted, interior surface 27 and exterior surface 29 of lower portion 34 have cylindrical configurations. Likewise, interior surface 27 and exterior surface 29 of upper portion 36 have cylindrical configurations. Interior surface 27 and exterior surface 29 of shoulder 38 have frustoconical configurations. As discussed below in more detail, interior surface 27 of blinding shell 14 inwardly constricts at shoulder 38 to both retain and cover vial 12 within blinding shell 14. However, exterior surface 29 of blinding shell 14 need not constrict at second end 24. For example, exterior surface 29 of blinding shell 14 could have a transverse cross section orthogonally passing through central longitudinal axis 40 that is constant between opposing ends 22 and 24. The transverse cross section could be circular, square, polygonal or have other configurations. Likewise, exterior surface 29 can vary continuously or at a variety of spaced apart locations relative to interior surface 27. However, having interior surface 27 and exterior surface 29 have complementary configurations can simplify production and minimize material costs.

As discussed below in greater detail, an annular recess 42 is formed on interior surface 27 of sidewall 18 at first end 22. In one embodiment, annular recess 42 has a tapered transverse cross section that helps to facilitate a secure snap-fit connection with floor plug 16, as discussed below. However, other configurations of slots can also be used.

In one embodiment, blinding shell 14 has a height $H_1$ extending between lips 26 and 30 that is typically at least or smaller than 4 cm, 5 cm, 6 cm, 8 cm, 10 cm or is in a range between any two of the foregoing values. Other dimensions can also be used. In addition diameter $D_1$ is typically at least or smaller than 1 cm, 1.5 cm, 2 cm, 2.5 cm, 3 cm, 4 cm or is in a range between any two of the foregoing values. Other dimensions can also be used.

As depicted in FIGS. 2 and 3, floor plug 16 is circular and has a top surface 48 and an opposing bottom surface 50 that both extend to an encircling side surface 52. An annular ridge 54 encircles and radially outwardly projects from side surface 52. Annular ridge 54 has a tapered cross section having a configuration complementary to annular recess 42 on blinding shell 14.

Floor plug 16 is configured to produce a snap-fit connection with blinding shell 14 and is sized to that floor plug 16 completely spans across compartment 20 when connected to blinding shell 14. Specifically, annular ridge 54 has a frustoconical top surface 56 that slopes outward and back toward bottom surface 50. The outer diameter of annular ridge 54 is slightly larger than the in inner diameter of lip 26 at first end 22 of blinding shell 14. During assembly, floor plug 16 is pressed into inlet opening 28 with top surface 56 pressing against lip 26. As force is applied to floor plug 16, the sloping of top surface 56 causes a slight outward expansion of lip 26, allowing ridge 54 to move or snap-fit into recess 42. Blinding shell 14 then resiliently contracts capturing annular ridge 54 within recess 42, thereby securing floor plug 16 to blinding shell 14 and completely covering inlet opening 28.

In one embodiment, the connection between floor plug 16 and blinding shell 14 can be considered a permanent attachment in that floor plug 16 cannot be manually removed from blinding shell 14 without the use of a tool or causing partial failure to floor plug 16 or blinding shell 14. The permanent attachment of floor plug 16 to blinding shell 14 helps to maintain the fidelity of the blinding study by ensuring that once vial 12 is captured within blinding shell 14 by the attachment of floor plug 16, vial 12 has not been accessed, tampered with or otherwise inspected though the removal of floor plug 16.

It is appreciated that other approaches can also be used for coupling floor plug 16 to blinding shell 14. For example, annular ridge 54 and recess 42 can be reversed. In other embodiments, floor plug 16 could be cup shaped and first end 22 of blinding shell 14 could snap fit into the recess of floor plug 16. In yet other embodiments, floor plug 16 could permanently attach to blinding shell 14 by welding, adhesive, press fitting or the like. Other techniques can also be used. However, the snap fit connection has a number of advantages, including ease of production and assembly.

Both blinding shell 14 and floor plug 16 are opaque. This can be accomplished by either forming blinding shell 14 and floor plug 16 from an opaque material or by applying an opaque coating, such as a paint or printing, or an opaque layer, such as an adhesive sticker covering. Other approaches can also be used so that blinding shell 14 and floor plug 16 are blacked out. In one embodiment, blinding shell 14 and floor plug 16 are molded or otherwise formed from a plastic such as Acrylonitrile Butadiene Styrene (ABS). ABS is an opaque thermoplastic and amorphous polymer. Other plastics/polymers can also be used. In still other embodiments, blinding shell 14 and floor plug 16 can be formed from a metal, glass, fiberglass, composite or the like.

As is shown in FIG. 3, vial 12 has an upper end 58 and an opposing lower end 59. Vial 12 includes a bottle 60 having a stopper 62 disposed thereon. Stopper 62 is secured in place by a retainer 64. More specifically, bottle 60 bounds a chamber 65 that is configured to hold a liquid trial product 67. As used herein, a "liquid trial product" refers to a liquid product being used in a blinded clinical trial and can include an active drug product that is under investigation, a related placebo product, a control product, or a comparator product.

Figure 5:
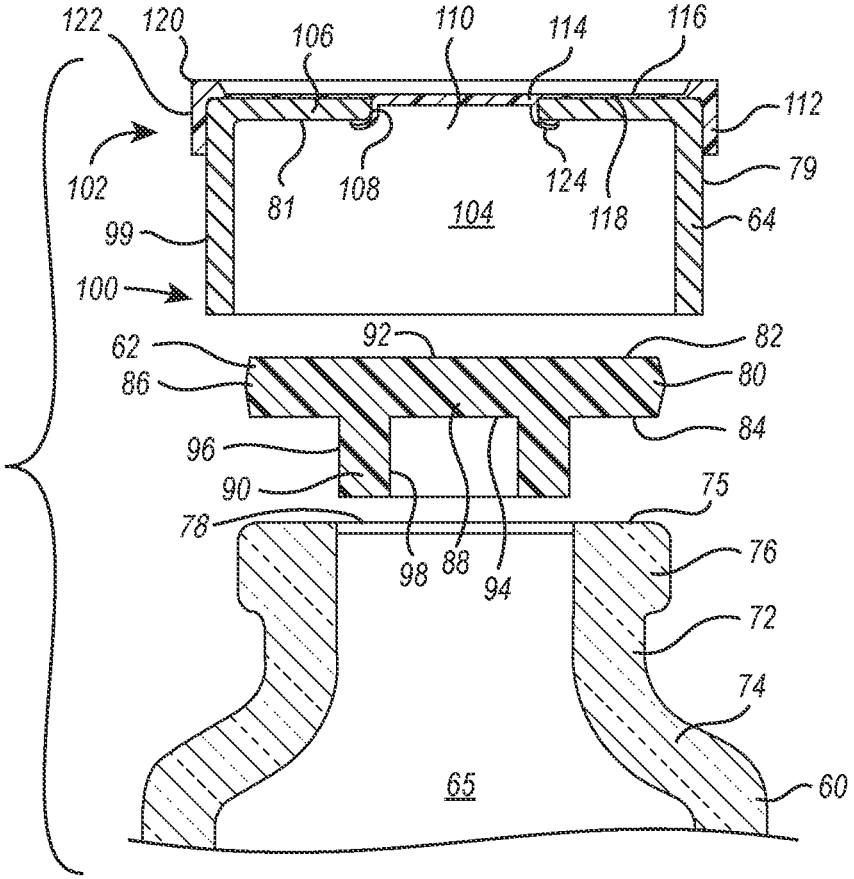
FIG. 5 is an exploded, cross sectional view of the upper end of the vial shown in FIG. 4.

Bottle 60 includes a body 66 having a circular floor 68 with cylindrical sidewall 70 upstanding therefrom. Bottle 60 also includes a neck 72 that is constricted relative to sidewall 70. An annular shoulder 74 inwardly slopes from an upper end of sidewall 70 to neck 72. As with shoulder 38 of blinding shell 14, shoulder 74 likewise inwardly slopes at an angle relative to a central longitudinal axis 73 of bottle 60. The angle of slope of shoulder 74 can be the same as discussed above with shoulder 38. As depicted in FIG. 5, neck 72 terminates at an end face 75. End face 75 encircles an opening 78 that communicates with chamber 65. An annular flange 76 radially outwardly projects from annular neck 72 adjacent to end face 75. Bottle 60 is typically made of glass or serializable plastic and is commonly transparent.

With continued reference to FIG. 5, stopper 62 comprises an annular top 80 having a top surface 82 and an opposing bottom surface 84. Opposing surfaces 82 and 84 can be planar and disposed in parallel alignment. However, some contours can also be disposed on one or both surfaces. Top 80 can further be defined as comprising an annular rim portion 86 that encircles a central septum 88. Septum 88 has a top surface 92 and an opposing bottom surface 94. Stopper 62 further comprises tubular stem 90 that projects from bottom surface 84 of top 80. Tubular stem 90 has an exterior surface 96 and an opposing interior surface 98. Interior surface 98 encircles bottom surface 94 of septum 88.

Stopper 62 is typically formed a single, integral, unitary member, as opposed to two or more members connected together, and is typically made from a rubber or elastomeric material that can produced a liquid tight seal with bottle 60. The material for stopper 62 is also selected so that a needle of a syringe can effectively pass through septum 88 for withdrawing a portion of liquid trial product 67 (FIG. 3) that is housed within bottle 60 and is self-sealing once the needle is withdrawn.

During assembly, stem 90 is advanced into opening 78 until rim portion 86 comes to rest on top of end face 75 of neck 72. In this configuration, exterior surface 96 of stem 90 sits against the interior surface of neck 72 to help effect a seal therebetween. Bottom surface 94 of septum 88 is aligned with chamber 65.

Stopper 62 is secured to bottle 60 by retainer 64. As also depicted in FIG. 5, retainer 64 comprises a circular collar 99 having a first end 100 and an opposing second end 102. Collar 99 encircles a cavity 104 that is configured to receive stopper 62 and at least a portion of neck 72 of bottle 60. Retainer 64 further comprises an annular flange 106 that radially inwardly projects from second end 102 of collar 64. Flange 106 terminates an inner face 108 that encircles an aperture 110. Although not necessarily required, in the embodiment depicted a cap 112 is shown removably secured to retainer 64. Cap 112 comprises a circular cover 114 having a top face 116 and an opposing bottom face 118 that both extend to a perimeter edge 120. Bottom face 118 is disposed on top of flange 106 of retainer 64. An annular lip 122 downwardly projects from perimeter edge 120. Cap 112 is configured so that cover 114 extends over flange 106 and aperture 110 of retainer 64 while lip 122 extends down along a portion of an exterior surface 79 of collar 99.

Downwardly projecting from bottom face 118 of cover 114 are a plurality of bendable fingers 124. Fingers 124 removably secure cap 112 to retainer 64 by passing through aperture 110 of retainer 64 and folding around inner face 108 so as to engage a bottom face 81 of flange 106. Retainer 64 and cap 112 are formed from a bendable material, such as a metal, and are typically formed from aluminum. In one embodiment, cap 112 is known as a flip-off cap.

Figure 4:
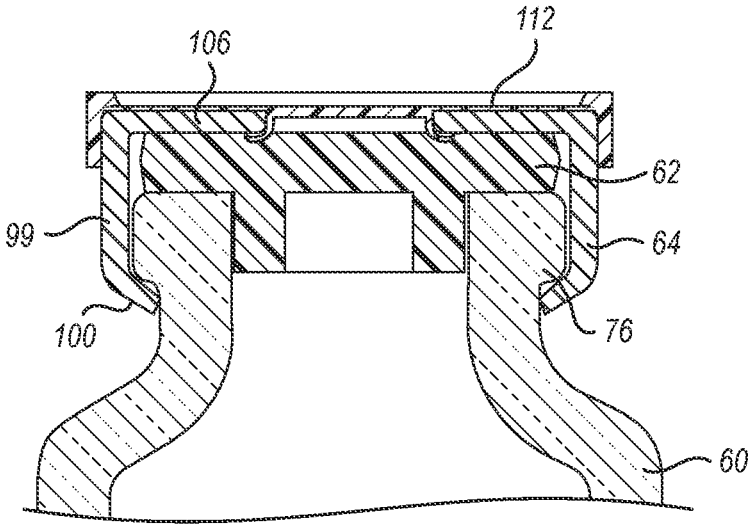
FIG. 4 is an enlarged cross sectional view of the upper end of the vial shown in FIG. 3.

With reference to FIGS. 4 and 5, during assembly stopper 62 is positioned on bottle 60 so as to cover opening 78, as discussed above. Retainer 64 with cap 112 is then advanced over stopper 62. Specifically, collar 99 is advanced over stopper 62 and over flange 76 of bottle 60 until flange 106 of retainer 64 rests on top of stopper 62 and first end 100 of collar 99 extends below flange 76 of bottle 60. Retainer 64 is then crimped onto bottle 60 by radially inwardly bending first end 100 of collar 99 below flange 76 of bottle 60. This crimping of retainer 64 functions to compress stopper 62 against end face 75 of bottle 60 to effect a liquid tight seal therebetween and also prevents manual separation of retainer 64 and stopper 62 from bottle 60 without the use of a tool or at least partial destruction of retainer 64. The crimping of retainer is typically achieved by a crimper that is passed over retainer 64 and then manipulated to radially inwardly compress first end 100 of collar 99. Such crimpers are known in the art.

Figure 7:
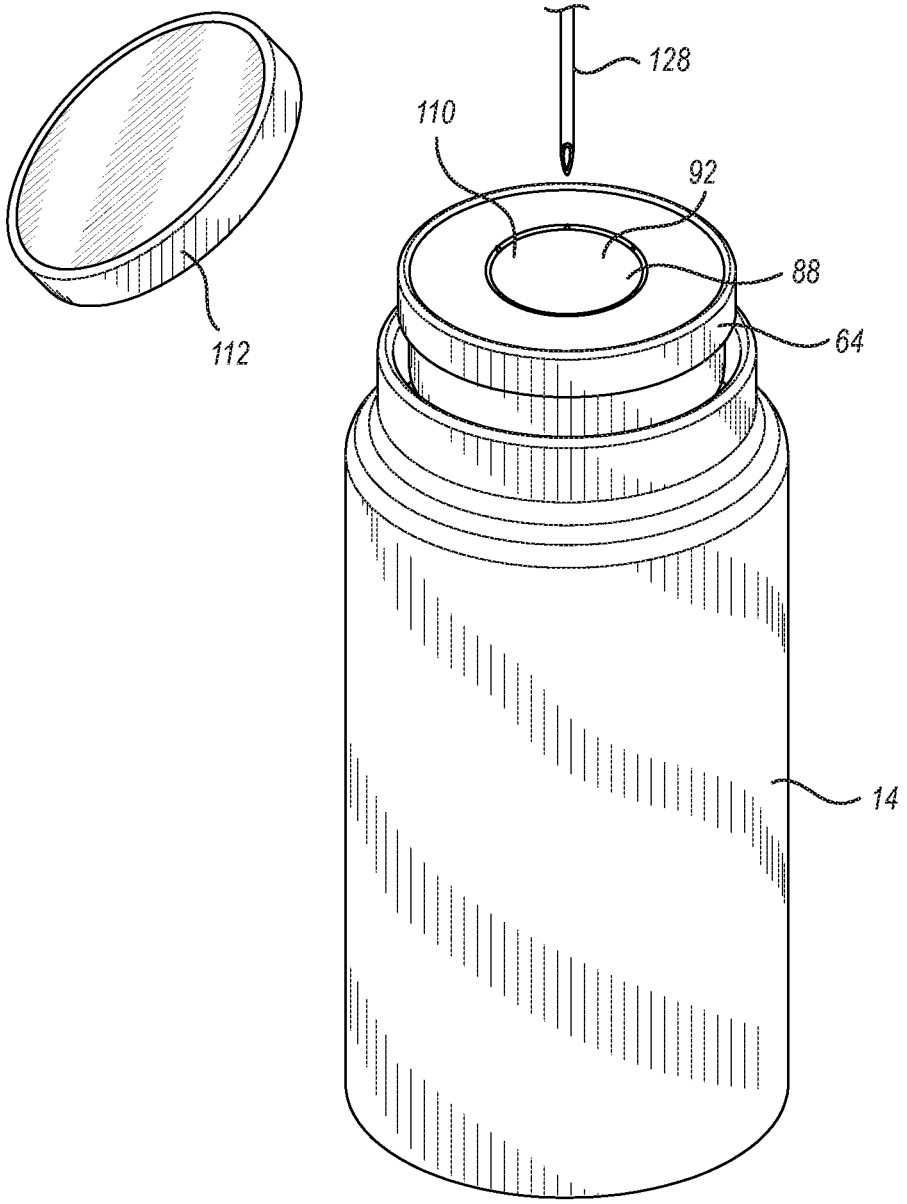
FIG. 7 is a perspective view of the vial blinding assembly shown in FIG. 1 having the cap thereof removed.

When it is desired to access liquid trial product 67 within vial 12, cap 112 can be removed from retainer 64 by manually, upwardly pressing against lip 122, such as with a user's thumb or other fingers. No tool is required. As the upward force is applied relative to retainer 64, fingers 124 bend so as to release cap 112 from retainer 64, as shown in FIG. 7. With cap 112 removed, top surface 92 of septum 88 is now openly exposed through aperture 110 of retainer 64. As such, a needle 128 of a syringe can be passed through septum 88 and into chamber 65 (FIG. 6) of bottle 60 to withdraw a portion of liquid trial product 67. It is noted that with retainer 64 securing stopper 62 to bottle 60, once cap 112 is removed, it cannot be reattached retainer 64. As such, the presence of cap 112 provides assurance that no tampering with liquid trial product 67 has occurred after retainer 64 and stopper 62 have been secured to bottle 60.

It is appreciated that retainer 64 can have a variety of different configurations and can be used in a variety of different ways and still function to secure stopper 62 to bottle 60. By way of example and not by limitation, in contrast to being crimped onto bottle 60, retainer 64 could be formed to produce a snap-fit connection with bottle 60 or could be formed in two halves that are clamped together about neck 72. In still other embodiments, the retainer could be attached by adhesive, press fit, or constriction under heating, e.g., shrink wrapping.

It is also note that cap 112 is not required and can be eliminated. However, if cap 112 is used, cap 112 can be removably secured to retainer 64 in a variety of other ways. For example, cap 112 can be attached by a single use adhesive strip or by using other forms of projects that replace fingers 124 (FIG. 5) but that removably extend under flange 106 of retainer 64. In other embodiments, fingers 124 can be replaced with spot welding or other separable attachments securing cap 112 to flange 106 of retainer 64. Other configurations can also be used.

With reference to FIG. 3, to use vial 12 with blinding shell 14, upper end 58 of vial 12 is advanced into blinding shell 14 through inlet opening 28. Once vial 12 is fully disposed within compartment 20 of blinding shell 14, as shown in FIG. 6, floor plug 16 is secured to first end 22 of blinding shell 14, as discussed above. Part of the function of floor plug 16 is to completely cover floor 68 of bottle 60 so that vial 12 cannot be seen through inlet opening 28, e.g., completely cover inlet opening 28, and to secure vial 12 within compartment 20. As such, floor plug 16 helps to ensure that vial 12 cannot be accessed or viewed through inlet opening 28, thereby helping to ensure the fidelity of the blinded study.

In the fully assembled configuration as shown in FIG. 6, floor 68 of bottle 60 sites directly on top surface 48 of floor plug 16. In this configuration, upper end 58 of vial 12 projects out through access opening 32 so as to extend out beyond blinding shell 14. Generally, blinding shell 14 and vial 12 are configured relative to each other so that in the assembly state shown in FIG. 6, cap 112 can be accessed for easy removal and top surface 92 of septum 88 can be accessed for easily cleaning, as discussed further below, but that liquid trial product 67 within vial 12 cannot be visually inspected or properties thereof determined.

For example, cap 112, retainer 64, and stopper 62 all have a maximum outside diameter that is smaller than inside diameter $D_3$ (FIG. 3) of upper portion 36 of blinding shell 14 so that they can easily pass through access opening 32. However, body 66/sidewall 70 of bottle 60 have an outside diameter that is larger than access opening 32 and larger than inner diameter $D_3$ of upper portion 36 of blinding shell 14 so that vial 12 cannot pass out through access opening 32. More specifically, shoulder 74 of vial 12 is stopped by shoulder 38 of blinding shell 14 so as to keep bottle 60 retained and covered within blinding shell 14. Expressed in other terms, shoulder 74 of vial 12 has an outside diameter larger than a diameter of access opening 32 of blinding shell 14 so that vial 12 is precluded from passing out of compartment 20 of blinding shell 14 through access opening 32.

Shoulders 38 and 74 are typically disposed at complementary angles so as to enable a close tolerance fit therebetween and to avoid or minimize any high stress contact points between bottle 60 and blinding shell 14. Furthermore, the difference between the outer diameter of body 66/sidewall 70 of bottle 60 and inner diameter $D_1$ of blinding shell 14 is typically less than 1 cm and commonly less than 0.5 cm so as to minimize unwanted movement or play of bottle 60 within blinding shell 14.

In addition, vial 12 and blinding shell 14 are typically configured so that top surface 92 of septum 88 and lip 30 of blinding shell 14 are separated by a linear height $H_2$ that is at least or less than 0.5 cm, 0.75 cm, 1 cm, 1.5 cm, or 2 cm or is in a range between any two of the foregoing dimensions. Commonly, $H_2$ is in a range between 0.5 cm and 2 cm and more commonly between 0.5 cm and 1.5 cm. The spacing of $H_2$ is designed to enable easy access to cap 112 for removal and easy access to top surface of 92 of septum 88 for cleaning. However, retainer 64 is configured so that in the assembled configuration, first end 100 of collar 99 extends into compartment 20 of blinding shell 14 and below lip 30 of blinding shell 14. As a result, when vial 12 is disposed within blinding shell 14, bottle 60 is completely covered by the combination of blinding shell 14, retainer 64, stopper 62 and floor plug 16 except for an annular gap 130 that is formed between lip 30 of blinding shell 14 and retainer 64. To minimize gap 130 so as to eliminate any ability to view or detect properties of liquid trial product 67 through gap 130, the difference between the outside diameter $D_5$ of retainer 64 and the inside diameter $D_3$ (FIG. 3) of upper portion 36 of blinding shell 14 is typically less than 1 cm and more commonly less than 0.6 cm or 0.4 cm. Minimizing gap 130 and increasing the distance between gap 130 and bottle 60 (such as by increasing the height of upper portion 36 of blinding shell 14) while forming blinding shell 14, retainer 64, stopper 62 and floor plug 16 from opaque materials, minimizes or eliminates any ability so visually inspect liquid trial product 67 within bottle 60.

During use, liquid trial product 67 is dispensed into chamber 65 of bottle 60. Stopper 62 is then seated on bottle 60, as discussed above, following which retainer 64 is advanced over stopper 62 and secured to bottle 60, as discussed above, so that stopper 62 is sealed to bottle 60. The assembled vial 12 housing liquid trial product 67 is then placed within blinding shell 14 and secured therein by the attachment of floor plug 16, as discussed above, thereby forming vial blinding assembly 10 as depicted in FIG. 1. Next, vial blinding assembly 10 is delivered to an individual or facility for administering the liquid trial product 67 contained therein consistent with the blinded trial protocols. To facilitate the administration of the liquid trial product 67, cap 112 is manually removed, as discussed above, so as to expose top surface 92 of septum 88, as shown in FIG. 7. As needed, top surface 92 of septum 88 that projects outside of blinding shell 14 can be cleaned/sterilized by applying a sterilizing agent. For example, alcohol or other sterilizing agents can be applied to top surface 92 such as through a pad, sponge or other wipe. Needle 128 of a syringe can then be passed down through septum 88 and a quantity of liquid trial product 67 withdrawn into the syringe. Once needle 128 is removed vial 12, the proper dosage of liquid trial product 67 can then be administered to the patient. For each subsequent administration, top surface 92 of septum 88 can again to cleaned/sterilized as discussed above and the process repeated.

Depending on a number of different factors, vials 12 used in a blinded study may come in different sizes. For example, a single blinded study may include an active drug product that is under investigation, a related placebo product, and a control product that are each prepackaged in a different facility using different sized vials. In other situations, vial sizes may change during different fill runs or when new vials are purchased. Independent of the cause, it is commonly desirable for all vials used in a blinded study to be presented in blinding shells that all appear to have the same identical configuration, i.e., size and shape, when viewed from the outside so that all vials appear to be identical. This helps to ensure that those administering or being administered liquid trial product 67 do not make assumptions or judgements as to what is being administered based on the size, shape or other properties of vial 12 and/or blinding shell 14.

Figure 8:
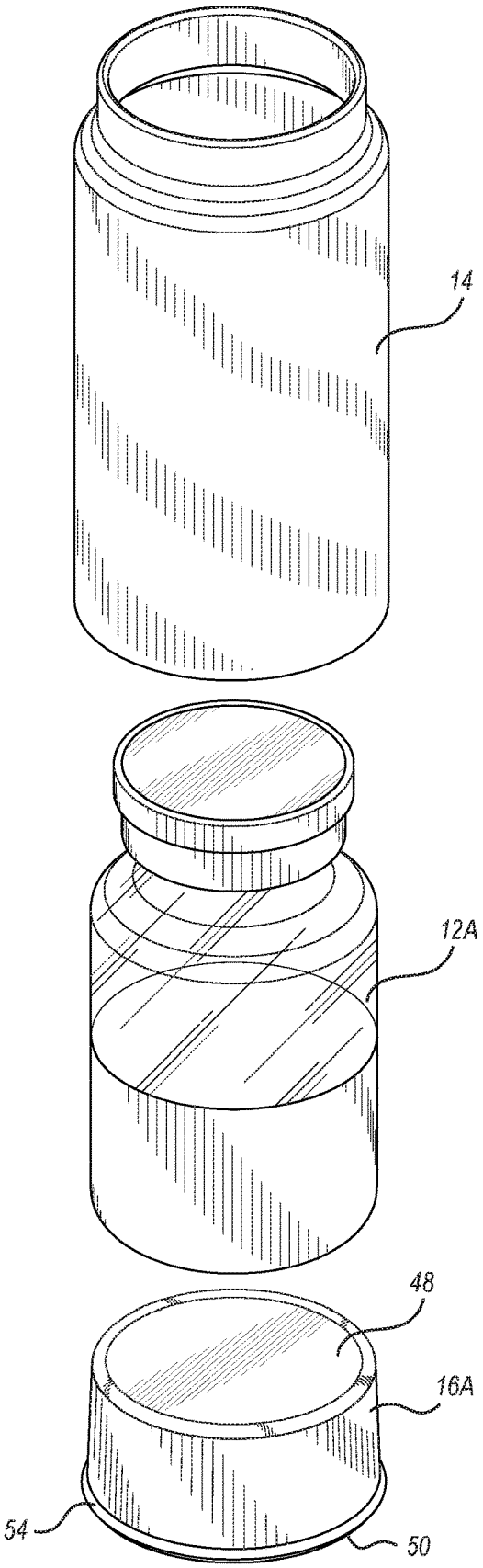
FIG. 8 is an exploded perspective view of an alternative embodiment of the vial blinding assembly shown in FIG. 1.

To that end, depicted in FIG. 8 is a vial blinding assembly 10A in a disassembled state. Like elements between vial blinding assembly 10 and 10A are identified by like reference characters. Vial blinding assembly 10A includes blinding shell 14, a vial 12A and a floor plug 16A. Vial 12A is identical to vial 12 except that it is shorter in length. Floor plug 16A is identical to floor plug 16 except that floor plug 16A has an increased thickness extending between top surface 48 and bottom surface 50 relative to floor plug 16.

Figure 9:
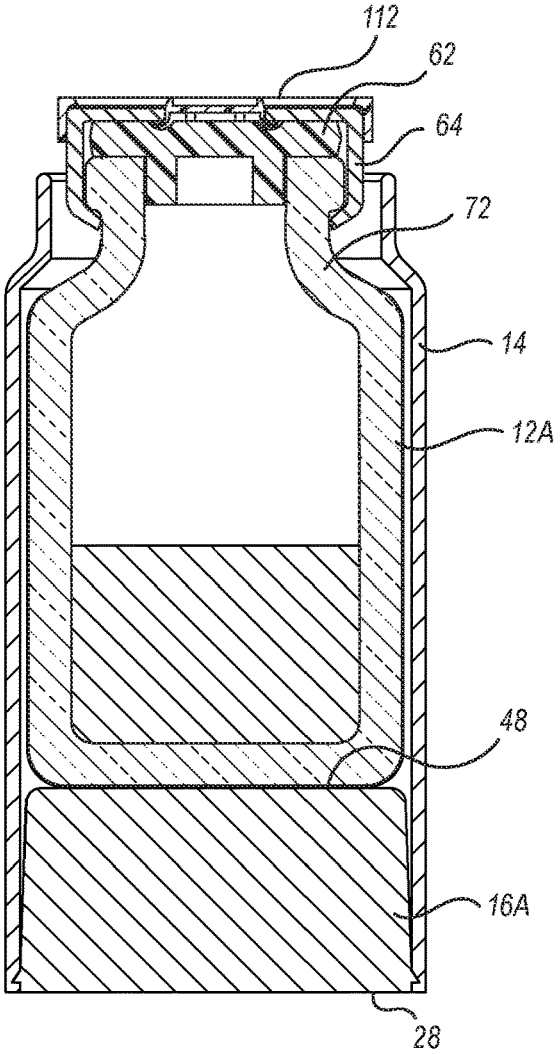
FIG. 9 is a cross section view of the assembled vial blinding assembly shown in FIG. 8.
Figure 10:
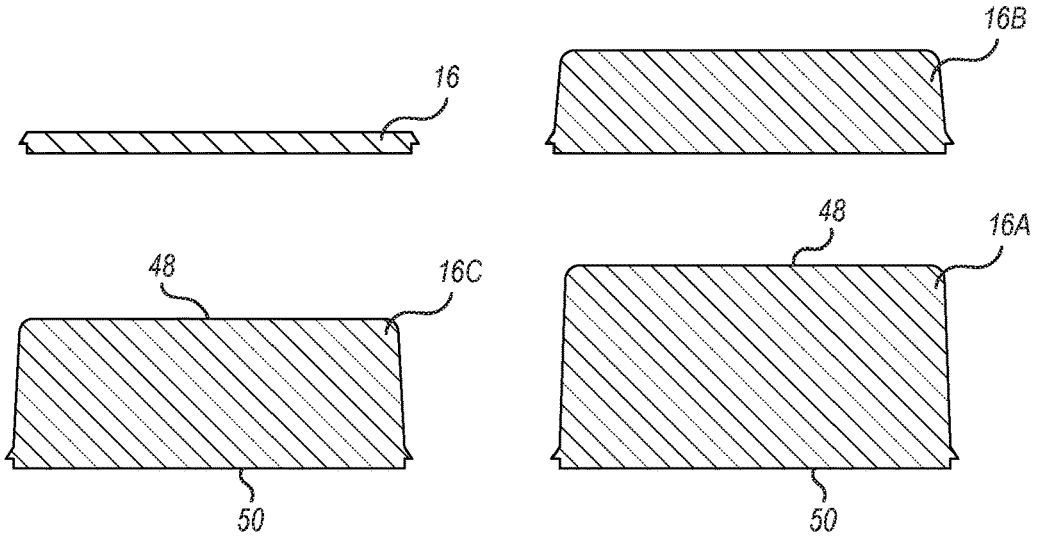
FIG. 10 are cross sectional side views of alternative floor plugs that can be used with the blinding shell shown in FIG. 9.

During assembly, as shown in FIG. 9, vial 12A is again advanced into blinding shell 14 in the same manner as previously discussed with regard to vial 12. Floor plug 16A is then advanced into inlet opening 28 of blinding shell 14 and secured in place, as previously discussed with regard to floor plug 16, so that vial 12A sits directly on top surface 48 of floor plug 16A. The thickness of floor plug 16A is specifically selected to compensate for the decreased height of vial 12A so that retainer 64, stopper 62, neck 72 and cap 112 (if used), all sit at the same positions relative to blinding shell 14, as previously discussed with regard to vial blinding assembly 10, so that there is no visual external difference between vial blinding assembly 12A and vial blinding assembly 12. To account for a plurality of different vials having different heights, a plurality of different floor plugs can be produced that each have a different thickness. For example, at least two, three, four, five or more different floor plugs can be produced that each have a different thickness. FIG. 10 shows an example of four different floor plugs 16, 16A, 16B and 16C that each have a different thicknesses extending between a top surface 48 and an opposing bottom surface 50 but which can each be received within and coupled to blinding shell 14. In one embodiment, the floor plugs can have a maximum thickness extending between the top surface 48 and bottom surface 50 that is greater than 0.5 cm, 1 cm, 1.5 cm or 2 cm or in a range between any two of the foregoing values. In another embodiment, the floor plugs can have a maximum thickness extending between the top surface 48 and bottom surface 50 that is less than 0.5 cm, 0.3 cm, or 0.2 cm or in a range between any two of the foregoing values.

Figure 11:
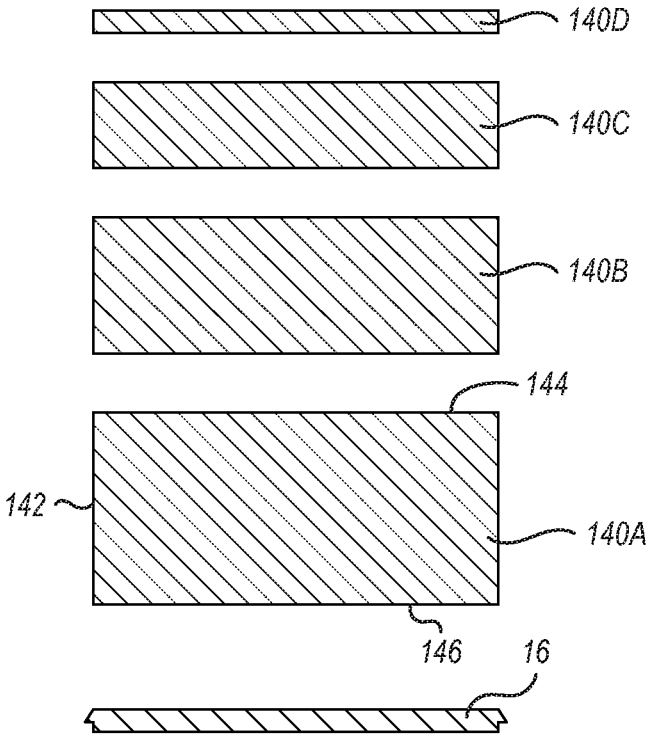
FIG. 11 is cross sectional side view of inserts of different thicknesses that can be used with the vial blinding assembly shown in FIG. 8.

In contrast to having a plurality of floor plugs that each have a different thickness to compensate for vials having different heights, a single floor plug can be used in combination with inserts of different thicknesses. For example, depicted in FIG. 11 is floor plug 16 that can be used with one or more of inserts 140A, 140B, 140C and/or 140D. Each insert has a cylindrical configuration with an encircling sidewall 142 that extends between a top surface 144 and an opposing bottom surface 146. Each insert 140 is configured to be received within compartment 20 of blinding shell 14 and has a different thickness extending between top surface 144 and an opposing bottom surface 146. The thickness of inserts 140 can be the same as discussed above with regard to the floor plugs. Accordingly, based on the height of vial 12A being used, one or more of inserts 140 can be positioned within blinding shell 14 between vial 12A and floor plug 16 so that again retainer 64, stopper 62, neck 72 and cap 112 (if used) of vial 12A, sit at the same position relative to blinding shell 14, as previously discussed with regard to vial blinding assembly 10, so that there is no visual external difference between the vial blinding assembly using an insert 140 and vial blinding assembly 10. In this embodiment, vial 12A can sit directly on top of an insert 140 while an insert 140 can sit directly on top of floor plug 16. It is noted that inserts 140 need not be cylindrical but can be any shape that will fit within compartment 20 of blinding shell 14 (FIG. 3) and will adequately support vial 12A on top of floor plug 16.

It is appreciated that vial blinding assembly 10 along the alternatives thereof and the components thereof have unique and beneficial advantages. For example, because the retainer and stopper at least partially project out of the blinding shell, a removable cap can be used to cover the septum prior to the initial use of the vial. Use of the cap helps to ensure that there has been no prior tampering to the liquid trial product housed within the vial and helps to keep the septum clean. Furthermore, once the cap is removed, the top surface of the septum is openly exposed so that it can be easily and repeatedly cleaned by applying a sterilizing agent, thereby helping to minimize contamination of the liquid trial product.

In addition, the ability to use a single blinding shell with floor plugs having different thicknesses or with a single sized floor plug but with inserts of different thicknesses, enables vial blinding assemblies to be produced with different sized vials where all vial blinding assemblies have the same, identical exterior configuration. Having vial blinding assemblies that all have the same exterior configuration, independent of the size of the vial, improves the efficacy of the blinded trial. The assembly also eliminates or limits the need to produce and/or store blinding shells of different configurations.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

It will also be appreciated that systems, processes, and/or products according to certain embodiments of the present disclosure may include, incorporate, or otherwise comprise properties features (e.g., components, members, elements, parts, and/or portions) described in other embodiments disclosed and/or described herein. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, processes, products, and the like are not described herein in particular detail in order to avoid obscuring aspects of the example embodiments. Such aspects are, however, also contemplated herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed is:

1. A vial blinding assembly comprising:

a vial comprising:

a bottle comprising a body, a constricted annular neck, and an annular shoulder that inwardly extends from the body to the neck, the neck bounding an opening to a chamber of the bottle;

a stopper disposed on the bottle so as to cover the opening, the stopper comprising a needle penetrable septum aligned within the opening, the septum having a top surface disposed outside of the chamber of the bottle; and a retainer securing the stopper to the bottle;

a tubular blinding shell having a sidewall that encircles a compartment and that extends between a first end and an opposing second end, the sidewall encircling an inlet opening at the first end and an access opening at the second end, the sidewall of the tubular blinding shell comprising:

a tubular lower portion that includes the first end and that has a maximum outer diameter;

a tubular upper portion that includes the second end and that has a maximum outer diameter, the maximum outer diameter of the lower portion being larger than the maximum outer diameter of the upper portion; and an annular shoulder inwardly extending from the lower portion to the upper portion and completely encircling the compartment; and a floor plug secured to the first end of the blinding shell;

wherein the vial is disposed within the compartment of the blinding shell with the vial being supported by the floor plug and the neck passing through the access opening so that the top surface of the septum is disposed outside of the compartment of the blinding shell, the shoulder of the vial having an outside diameter larger than a diameter of the access opening of the blinding shell so that the vial is precluded by the annular shoulder of the sidewall from passing out of the compartment of the blinding shell through the access opening, wherein the second end of the blinding shell terminates at an annular lip that radially encircles the retainer so that at least a portion of the retainer projects above the annular lip and at least a portion of the retainer projects below the annular lip.

2. The vial blinding assembly as recited in claim 1, wherein the floor plug couples with the blinding shell by a snap fit connection so that the floor plug cannot be manually separated from the blinding shell.

3. The vial blinding assembly as recited in claim 1, further comprising:

the blinding shell having an interior surface with an annular recess being formed into the interior surface at the first end so that the annular recess encircles the compartment; and the floor plug having an annular ridge received within the recess.

4. The vial blinding assembly as recited in claim 1, wherein the retainer comprises:

an annular collar encircling a portion of the bottle and encircling a portion of the stopper; and a flange radially inwardly projecting from an upper end of the collar so as to extend over a portion of the stopper, the flange terminating at an inner face that encircles an aperture, the aperture being aligned with the top surface of the septum.

5. The vial blinding assembly as recited in claim 4, further comprising a cap removably coupled to the retainer so as to cover the aperture of the retainer and the top surface of the septum.

6. The vial blinding assembly as recited in claim 1, further comprising a liquid trial product disposed within the chamber of the bottle.

7. The vial blinding assembly as recited in claim 1, further comprising one or more inserts disposed between the floor plug and the vial.

8. The vial blinding assembly as recited in claim 1, wherein the annular lip at the second end of the blinding shell comprises a continuous, circular configuration.

9. The vial blinding assembly as recited in claim 1, wherein the upper portion, lower portion and annular shoulder of the blinding shell form a single, unitary, continuous structure.

10. A method for assembling a vial blinding assembly comprising:

passing a vial through an inlet opening at a first end of a tubular blinding shell and into a compartment of the blinding shell, the vial comprising:

a bottle comprising a body, a constricted annular neck, and an annular shoulder that inwardly extends from the body to the neck, the neck bounding an opening to a chamber of the body;

a stopper disposed on the bottle so as to cover the opening, the stopper comprising a needle penetrable septum aligned within the opening, the septum having a top surface disposed outside of the chamber of the bottle; and a retainer securing the stopper to the bottle; and securing a floor plug to the first end of the blinding shell so that the vial is supported by the floor plug, the neck of the bottle passing through an access opening at an opposing second end of the blinding shell so that the top surface of the septum is disposed outside of the compartment of the blinding shell, the second end of the blinding shell terminating at a continuous, annular lip having a circular configuration, the shoulder of the vial having an outside diameter larger than a diameter of the access opening of the blinding shell so that the vial is precluded from passing out of the compartment of the blinding shell through the access opening, the tubular blinding shell having a sidewall comprising:

a tubular lower portion that includes the first end and that has a maximum outer diameter;

a tubular upper portion that includes the second end and that has a maximum outer diameter, the maximum outer diameter of the lower portion being larger than the maximum outer diameter of the upper portion; and an annular shoulder inwardly extending from the lower portion to the upper portion and completely encircling the compartment.

11. The method as recited in claim 10, wherein the step of securing the floor plug comprises selecting the floor plug from a plurality of floor plugs, each of the plurality of floor plugs having a top surface and an opposing bottom surface with a maximum thickness extending therebetween, each of the plurality of floor plugs having a different maximum thickness.

12. The method as recited in claim 10, further comprising removing a cap secured to the retainer so as to openly expose the septum of the stopper.

13. The method as recited in claim 10, further comprising:

cleaning a top surface of the septum; and passing a needle of a syringe through the septum.

14. The method as recited in claim 13, wherein the step of cleaning the top surface of the septum comprises applying a sterilizing agent to the top surface of the septum.

15. The method as recited in claim 13, wherein the step of cleaning the top surface of the septum comprises using a pad to manually apply a sterilizing agent to the top surface of the septum.

16. The method as recited in claim 13, further comprising:

using the syringe to withdraw a portion of a liquid trial product disposed within the chamber of the vial; and dispensing a dosage of the liquid trial product to a patient as part of a blinded study.

17. The method as recited in claim 10, further comprising positioning an insert into the compartment of the blinding shell so that the insert is disposed between the vial and the floor plug when the floor plug is secured to the blinding shell.

18. The method as recited in claim 17, wherein the insert is selected from a plurality of inserts each having a different thickness.

19. The method as recited in claim 10, wherein the annular lip at the second end of the blinding shell radially encircles the retainer so that at least a portion of the retainer projects above the annular lip and at least a portion of the retainer projects below the annular lip.

20. The method as recited in claim 10, wherein the upper portion, lower portion and annular shoulder of the blinding shell form a single, unitary, continuous structure.

* * * * *